US009777752B2

(12) United States Patent
Medeiros et al.

(10) Patent No.: US 9,777,752 B2
(45) Date of Patent: Oct. 3, 2017

(54) FLEXIBLE PNEUMATIC ACTUATOR

(71) Applicant: ELECTROMECHANICA, INC., Mattapoisett, MA (US)

(72) Inventors: Ruben Medeiros, North Dartmouth, MA (US); Andrew Phillip DeMedeiros, Fall River, MA (US); Stephen Armand Piché, North Easton, MA (US); Karl Reid Edminster, Fairhaven, MA (US)

(73) Assignee: ELECTROMECHANICA, INC., Massapoisett, MA (US)

( * ) Notice: Subject to any disclaimer, the term of this patent is extended or adjusted under 35 U.S.C. 154(b) by 140 days.

(21) Appl. No.: 14/971,657

(22) Filed: Dec. 16, 2015

(65) Prior Publication Data

US 2016/0177980 A1 Jun. 23, 2016

Related U.S. Application Data

(60) Provisional application No. 62/094,722, filed on Dec. 19, 2014.

(51) Int. Cl.

| | |
|---|---|
| ***F01B 19/04*** | (2006.01) |
| ***F15B 15/08*** | (2006.01) |
| ***F15B 15/12*** | (2006.01) |
| ***F15B 15/20*** | (2006.01) |
| ***F15B 15/14*** | (2006.01) |

(52) U.S. Cl.
CPC ..... *F15B 15/08* (2013.01); *F15B 15/125* (2013.01); *F15B 15/14* (2013.01); *F15B 15/149* (2013.01); *F15B 15/20* (2013.01); *F01B 19/04* (2013.01)

(58) Field of Classification Search
CPC ..... F15B 15/08; F15B 15/14; F15B 15/149; F15B 15/20; F01B 19/04
See application file for complete search history.

(56) References Cited

U.S. PATENT DOCUMENTS

| | | | | |
|---|---|---|---|---|
| 2,170,599 A * | 8/1939 | Stricklen | A61D 7/00 | 604/218 |
| 5,079,999 A * | 1/1992 | Negishi | F15B 15/103 | 92/92 |
| 5,083,498 A * | 1/1992 | Sato | F15B 15/103 | 92/89 |
| 6,152,014 A * | 11/2000 | Willimczik | F01B 3/0038 | 417/269 |

* cited by examiner

*Primary Examiner* — Michael Leslie
(74) *Attorney, Agent, or Firm* — Lando & Anastasi, LLP

(57) ABSTRACT

A flexible pneumatic actuator assembly includes a front base, a rear base, a length of flexible tubing having a front end secured to the front base and a rear end secured to the rear base, a flexible piston rod extending through an aperture in the front base and into an internal volume of the length of flexible tubing, and a piston secured to the piston rod within the internal volume of the length of flexible tubing. The piston is configured to maintain an air tight seal against an inner wall of the tubing upon bending of the tubing in a region including the piston.

24 Claims, 16 Drawing Sheets

FLEXIBLE PNEUMATIC ACTUATOR

CROSS-REFERENCE TO RELATED APPLICATION

This application claims priority under 35 U.S.C. §119(e) to U.S. Provisional Application Ser. No. 62/094,722 titled "FLEXIBLE PNEUMATIC ACTUATOR" filed Dec. 19, 2014, which is incorporated herein by reference in its entirety for all purposes.

FEDERALLY SPONSORED RESEARCH

This invention was made with government support under Contract Nos. N00014-14-C-0072 and N00173-15-C-2026 awarded by the Office of Naval Research. The U.S. Government has certain rights in the invention.

BACKGROUND

1. Field of Disclosure

Aspects and embodiments of the present disclosure are directed generally to flexible pneumatic actuators and to devices including same.

2. Discussion of Related Art

Pneumatic cylinders are utilized as actuators in numerous devices, for example, robots, construction equipment, and machine tools. Conventional pneumatic actuators are rigid and cannot bend.

SUMMARY

In accordance with a first aspect, there is provided a flexible pneumatic actuator assembly. The flexible pneumatic actuator assembly comprises a front base, a rear base, a length of flexible tubing having a front end secured to the front base and a rear end secured to the rear base, a flexible piston rod extending through an aperture in the front base and into an internal volume of the length of flexible tubing, and a piston secured to the piston rod within the internal volume of the length of flexible tubing. The piston is configured to maintain an air tight seal against an inner wall of the tubing upon bending of the tubing in a region including the piston.

In some embodiments, the piston is secured to a rear end of the piston rod within the internal volume of the length of flexible tubing.

In some embodiments, the piston is substantially spherical in shape.

In some embodiments, a front end of the piston is secured to the piston rod with a compression tube fitting adapter.

In some embodiments, the piston is configured to maintain an interference fit against the inner wall of the tubing upon bending of the tubing in a region including the piston. The piston may be configured to rotate within the tubing upon bending of the tubing in a region including the piston.

In some embodiments, the flexible pneumatic actuator assembly further comprises a fluid inlet and a network of pneumatic passageways and valves configured to selectively apply fluid to the interior of the tubing on different sides of the piston. The flexible pneumatic actuator assembly may further comprise control circuitry disposed within the rear base and configured to control operation of the valves. The network of pneumatic passageways may include a fluid line pneumatically coupling the front base to the rear base.

In some embodiments, the front base includes a tapered snout including an undercut and a tube clamp, the front end of the length of tubing secured in place between an external surface of the snout and the tube clamp.

In some embodiments, the flexible pneumatic actuator assembly further comprises a streamlined nose seal cap disposed on a front face of the front base.

In some embodiments, the flexible pneumatic actuator assembly further comprises a rear cover sealing a control board in the rear base and including a pneumatic fluid inlet.

In some embodiments, the flexible pneumatic actuator assembly has a single pneumatic fluid supply line.

In some embodiments, the piston rod is formed from an engineering plastic.

In some embodiments, the flexible pneumatic actuator assembly further comprises one or more seals in the aperture forming an air tight seal against the piston rod. The one or more seals may maintain an airtight seal on the piston rod when a lateral force is applied to bend a portion of the piston rod protruding from the front base.

In some embodiments, the flexible pneumatic actuator assembly further comprises a rod connector fastened to a front end of the piston rod. The rod connector may be formed with a streamlined shape without sharp edges. The rod connector may include a compression tube fitting disposed within a body of the rod connector, the compression tube fitting securing the front end of the piston rod to the rod connector.

In some embodiments, the piston includes a flat rear end.

In some embodiments, the piston rod is configured to apply force to a load in a direction up to about 90° relative to a centerline of the pneumatic actuator assembly. In some embodiments, the piston rod is operable to both push and pull on a load after the length of flexible tubing has been bent into a curved state.

In some embodiments, the piston is one of coated with a friction reducing material. In some embodiments, the piston is formed from a low friction material.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
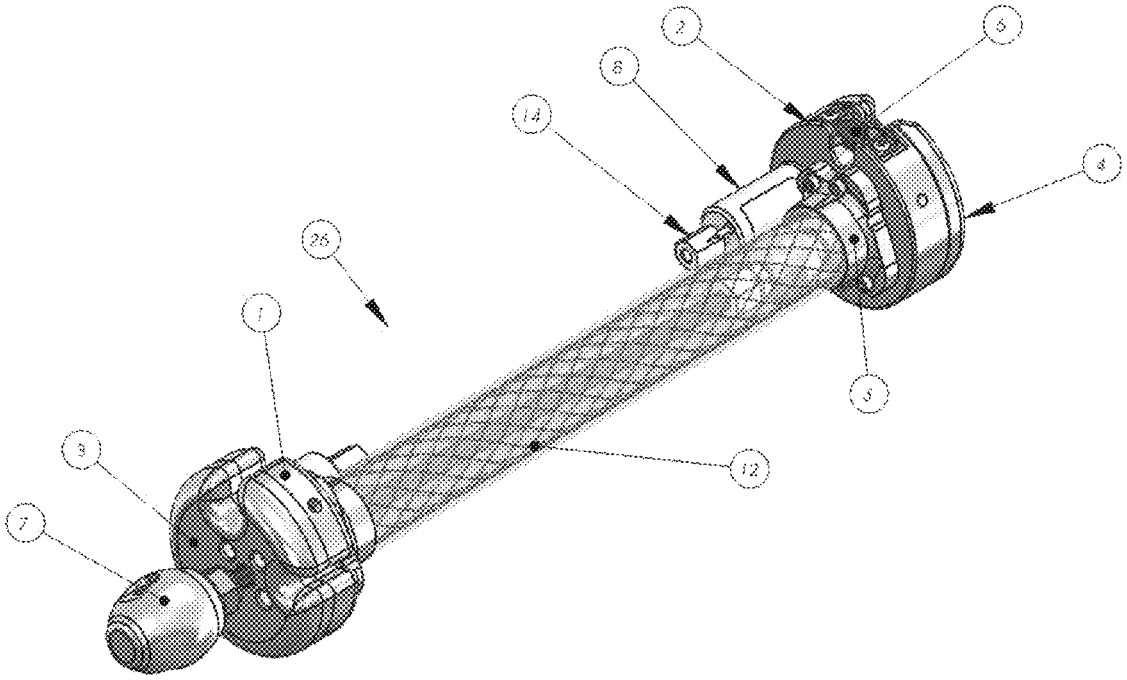
FIG. 1 is an isometric view of an embodiment of a flexible actuator assembly.

Aspects and embodiments disclosed herein are not limited to the details of construction and the arrangement of components set forth in the following description or illustrated in the drawings. Aspects and embodiments disclosed herein are capable of other embodiments and of being practiced or of being carried out in various ways.

It has been found that conventional rigid pneumatic actuators can be difficult or impossible to use in space-constrained environments, for example, in a pipe inspections robot passing through a pipe, where the confined space in the space-constrained environment may bend or curve. A need exists for a non-rigid pneumatic actuator which can function inside non-linear (e.g., curved or bent) confined spaces. Aspects and embodiments disclosed herein are generally directed to flexible pneumatic actuators and to devices including same.

In one embodiment, a flexible pneumatic actuator assembly 26 includes a front base 1 and a rear base 2 mechanically coupled by a length of a tubing 12. In some embodiments, the tubing 12 may be a high pressure tubing capable of withstanding a pressure differential from an internal volume of the tubing to an outside of the tubing of at least, for example, 100 psi (0.7 MPa).

Figure 6:
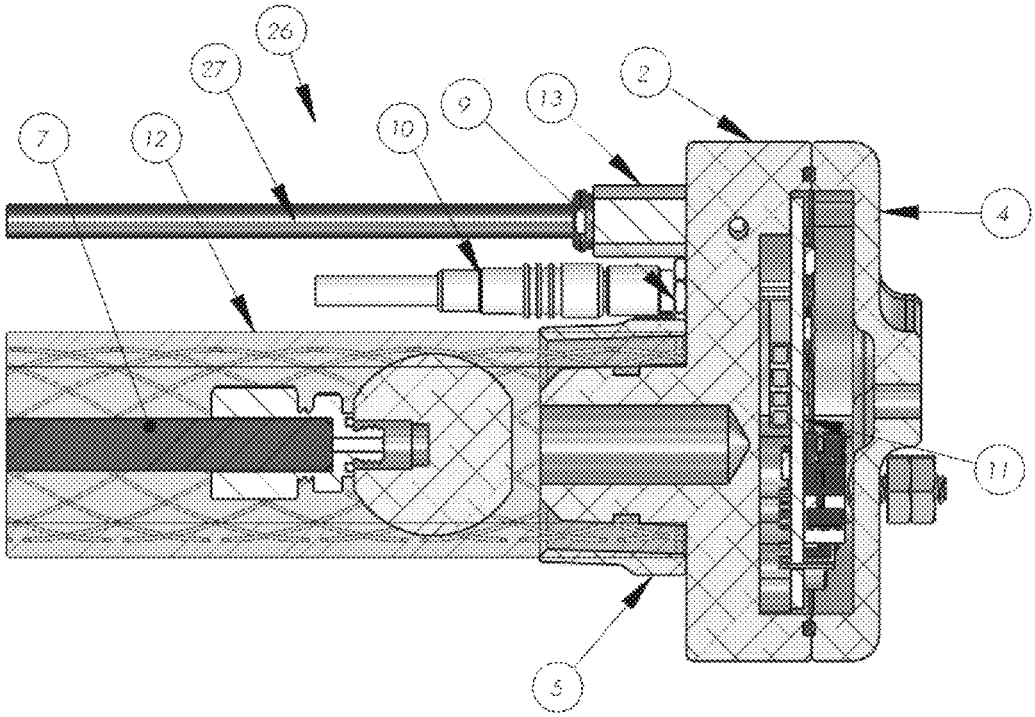
FIG. 6 is a cross sectional view of the rear base assembly of the flexible actuator assembly of FIG. 1.
Figure 7:
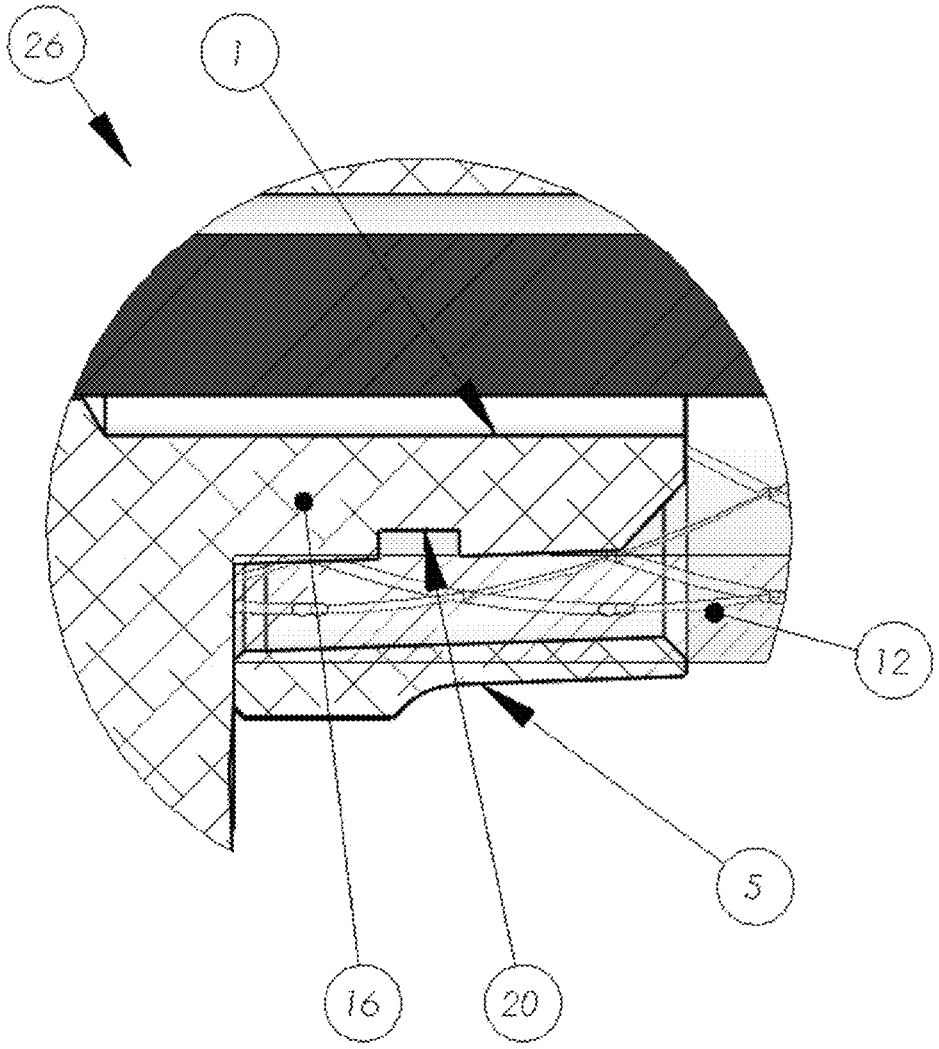
FIG. 7 is an expanded cross sectional view of a region of attachment of a tube of the flexible actuator assembly to the front base of the flexible actuator assembly.
Figure 8:
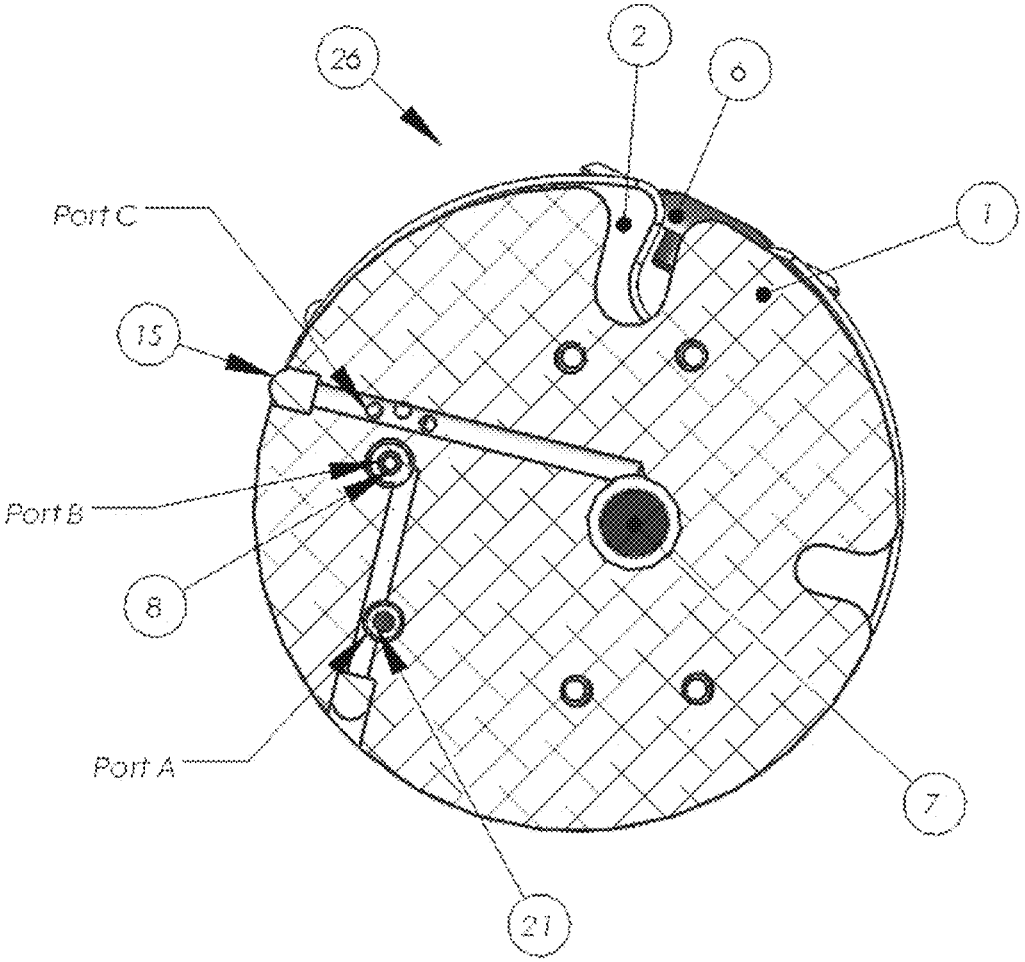
FIG. 8 is a cross-sectional view of the front base of the flexible actuator assembly of FIG. 1.
Figure 9:
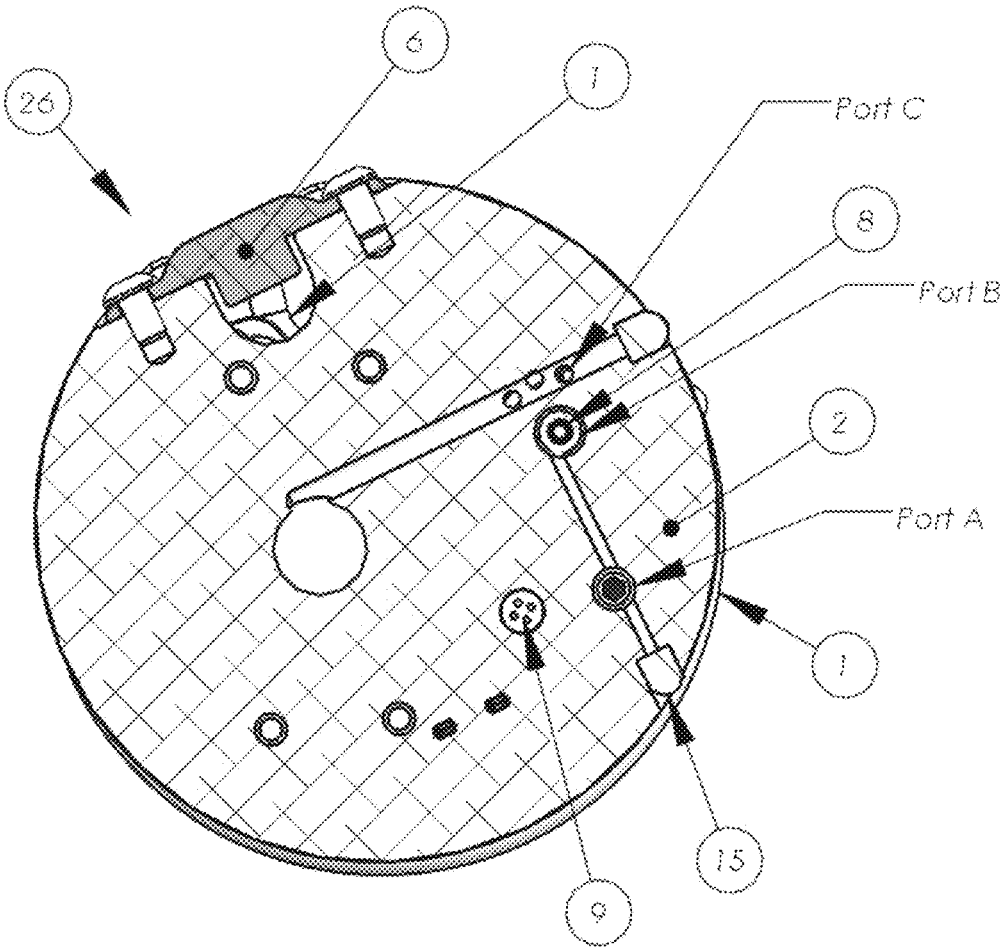
FIG. 9 is a cross-sectional view of the rear base of the flexible actuator assembly of FIG. 1.
Figure 12:
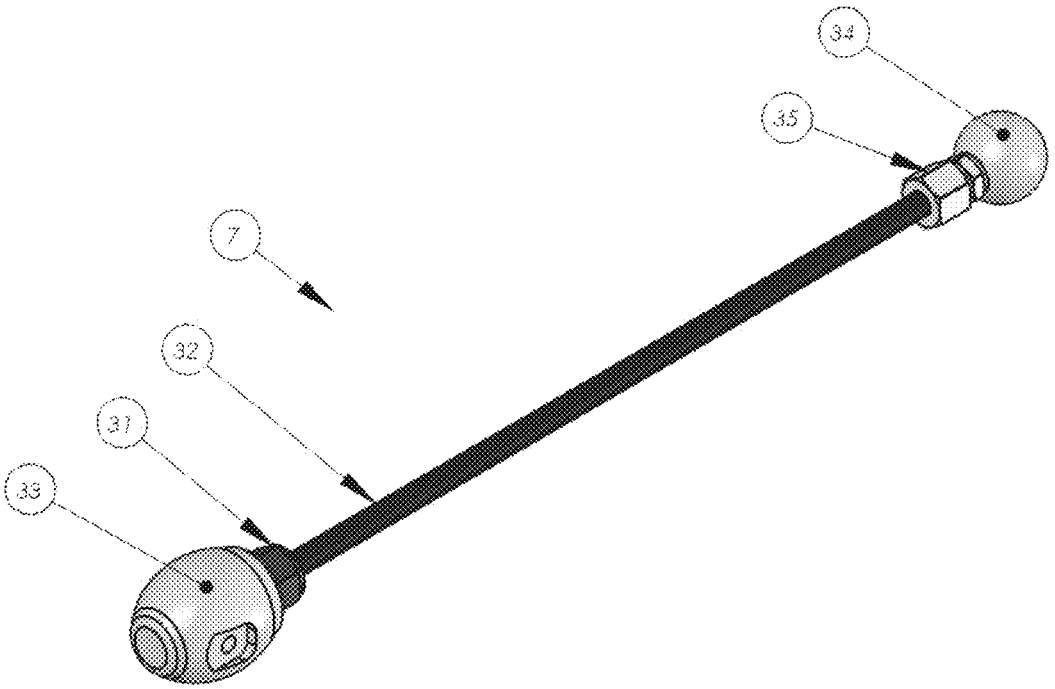
FIG. 12 is an isometric view of the piston assembly of the flexible actuator assembly of FIG. 1.
Figure 13:
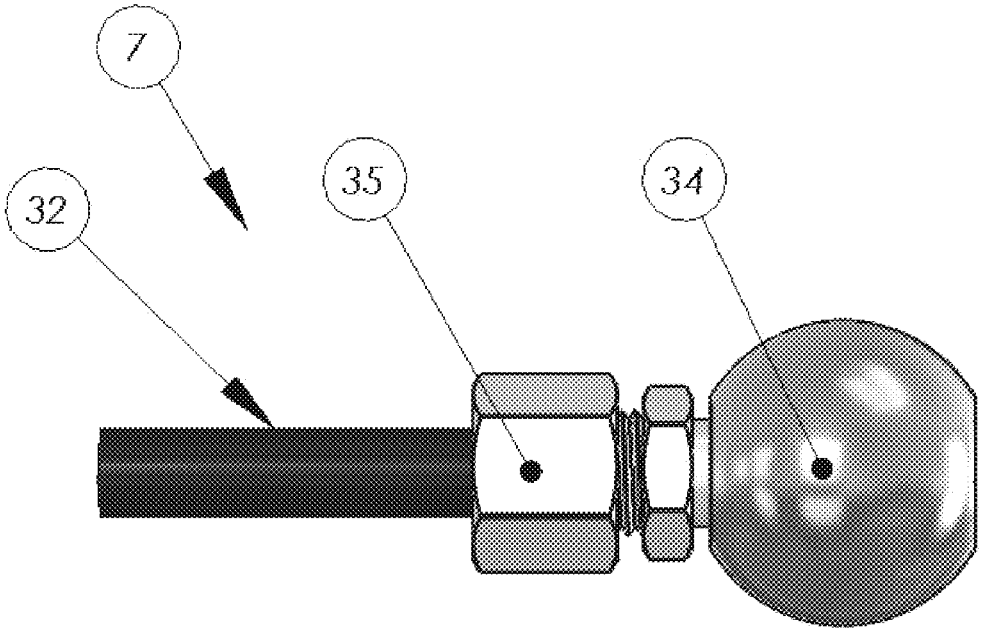
FIG. 13 is an elevational view of a piston of the piston assembly of FIG. 12.
Figure 14:
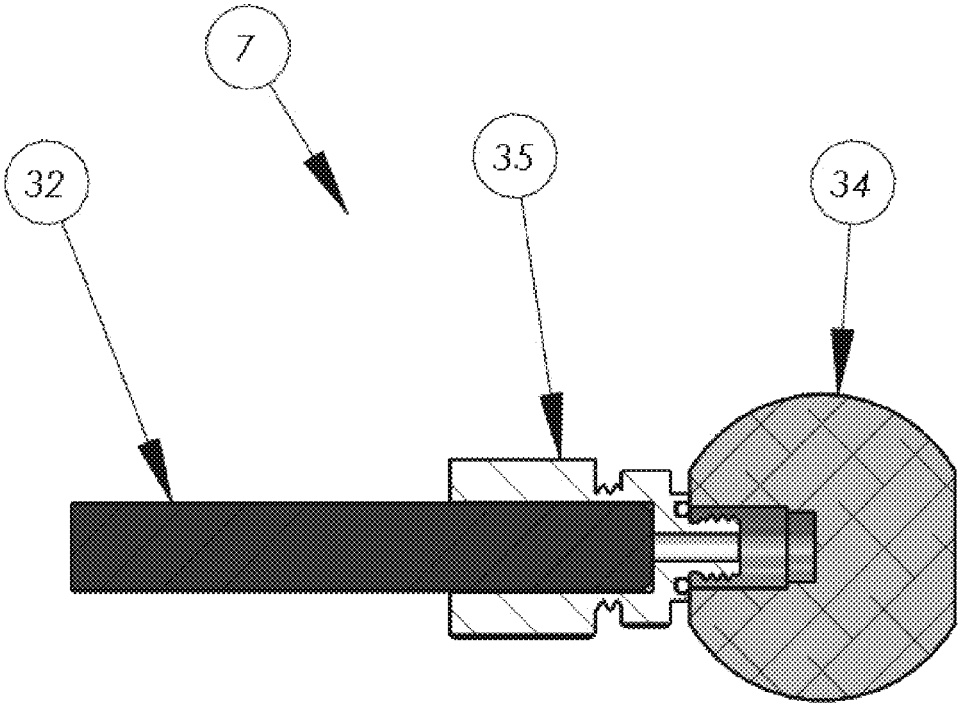
FIG. 14 is a cross-sectional view of a piston of the piston assembly of FIG. 12.
Figure 15:
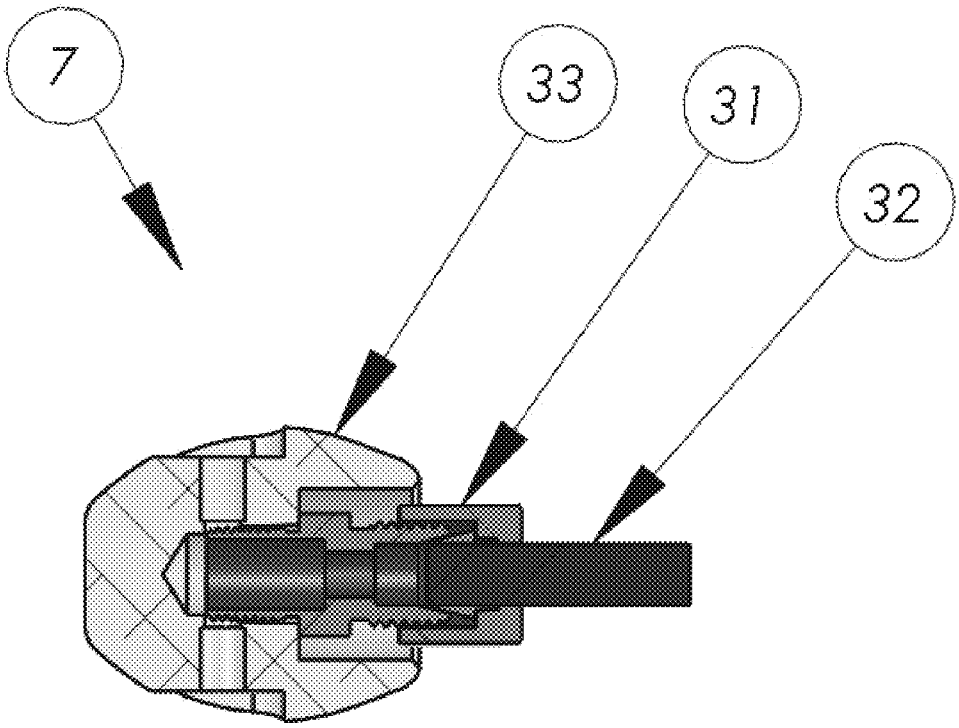
FIG. 15 is a cross sectional view of a rod connector of the piston assembly of FIG. 12.
Figure 16:
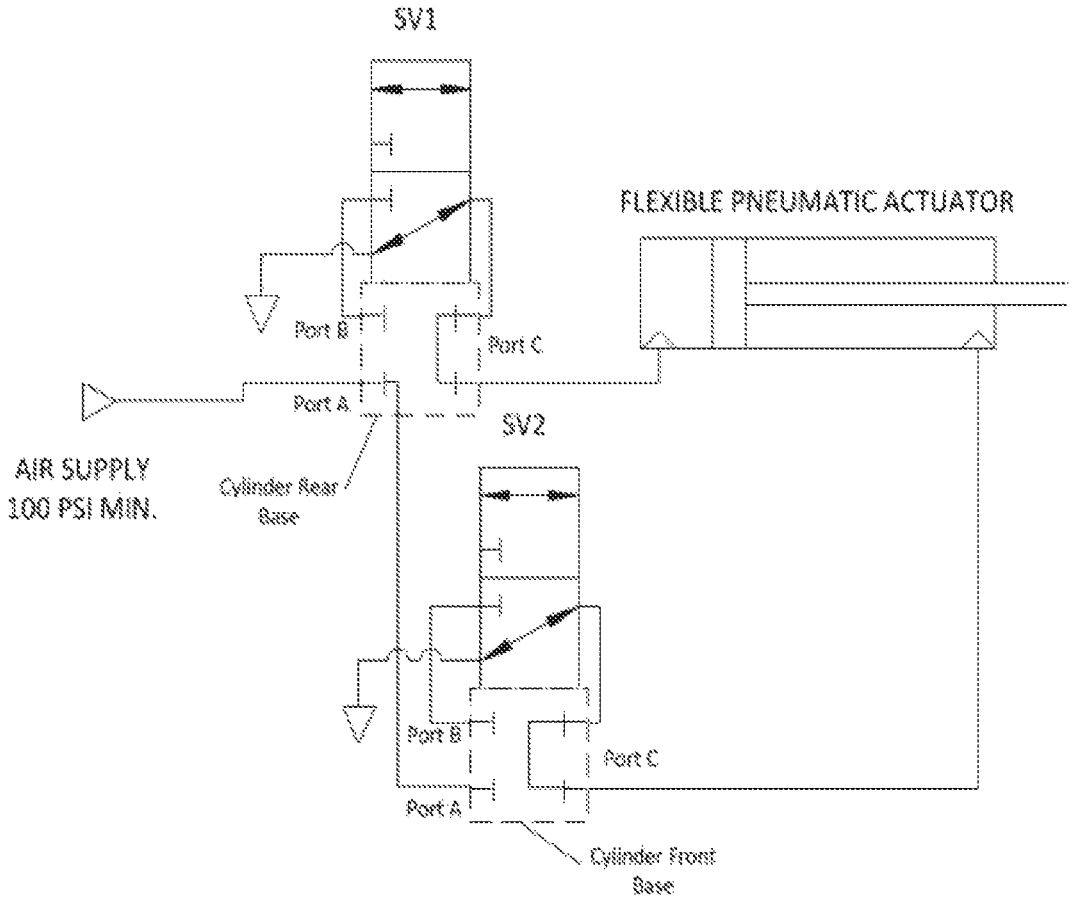
FIG. 16 is a pneumatic schematic of the flexible actuator assembly of FIG. 1.

A piston assembly 7, including a piston rod 32 and a substantially spherical ball piston 34 (see FIG. 12) is disposed within the tubing 12 and includes a portion including a rod connector 33 extending through an aperture in the front base 1. The piston rod 32 is operable to both push and pull on a load during flexure or bending of the tubing 12 or after the tubing 12 has been bent into a curved state. The ball piston 34 is a substantially spherical ball which creates an air tight seal against the inner wall of the tubing 12. In some embodiments, the ball piston 34 may not be completely spherical. In some embodiments, the ball piston 34 may be partially spherical, a spherical segment, or a spherical frustum. Ball piston 34 may include a flattened front surface for connecting to other portions of the piston assembly 7, for example, compression tube fitting adaptor 35, and/or a flattened rear surface, as illustrated in FIG. 6. The ball piston 34 relies on an interference fit to maintain an air tight seal against the inner wall of the tubing 12 even as the tubing 12 is bent. When formed in the shape of a spherical segment, the spherical surface, or spherical zone of the ball piston 34 maintains an air tight seal against the inner wall of the tubing 12. When the tubing 12 is bent, the ball piston 34 rotates inside of the tubing, much like a ball joint in a ball joint socket. During rotation the geometry of the ball piston 34 does not change, allowing the ball piston 34 to maintain an air tight seal within the tubing 12 while the tubing is bending and/or is in a bended state.

Figure 2:
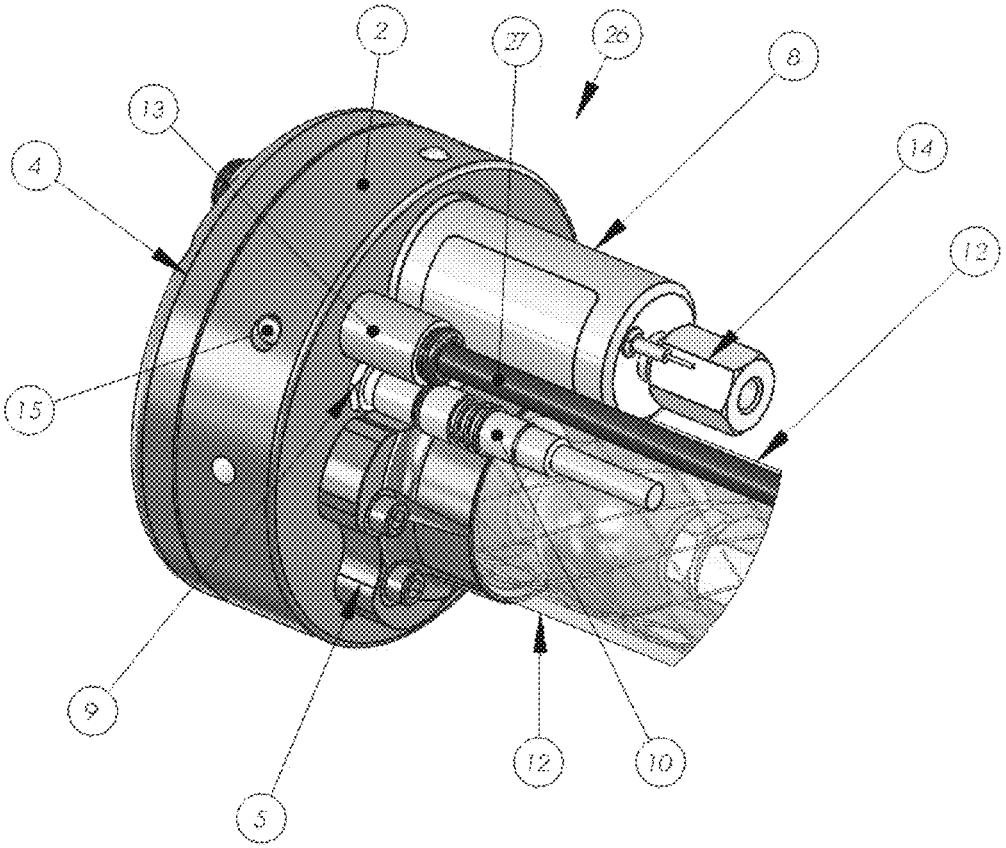
FIG. 2 is an isometric view of a rear base assembly of the flexible actuator assembly of FIG. 1.
Figure 3:
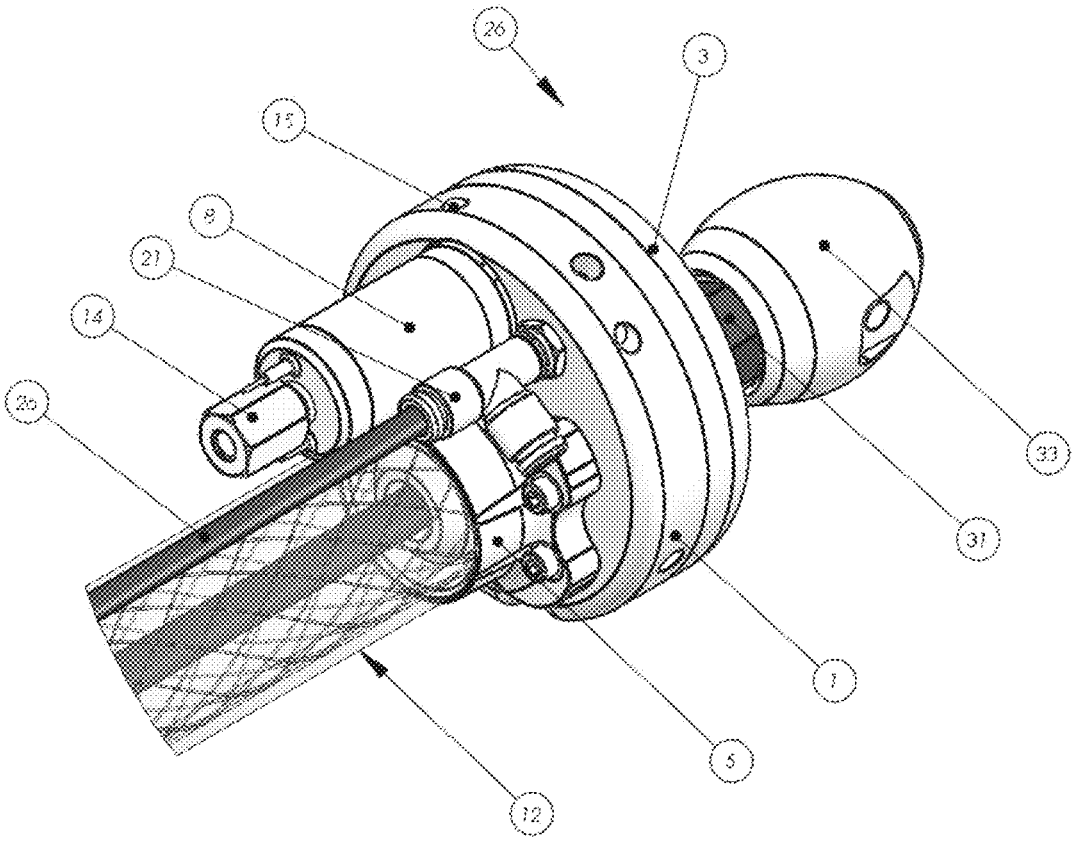
FIG. 3 is an isometric view of a front base assembly of the flexible actuator assembly of FIG. 1.
Figure 4:
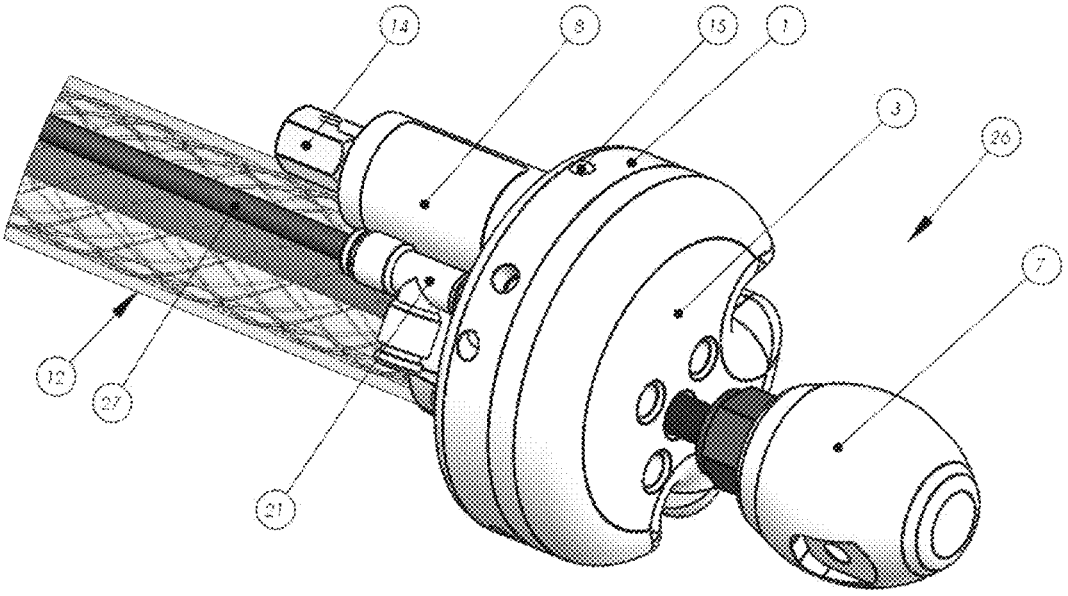
FIG. 4 is another isometric view of the front base assembly of the flexible actuator assembly of FIG. 1.
Figure 11:
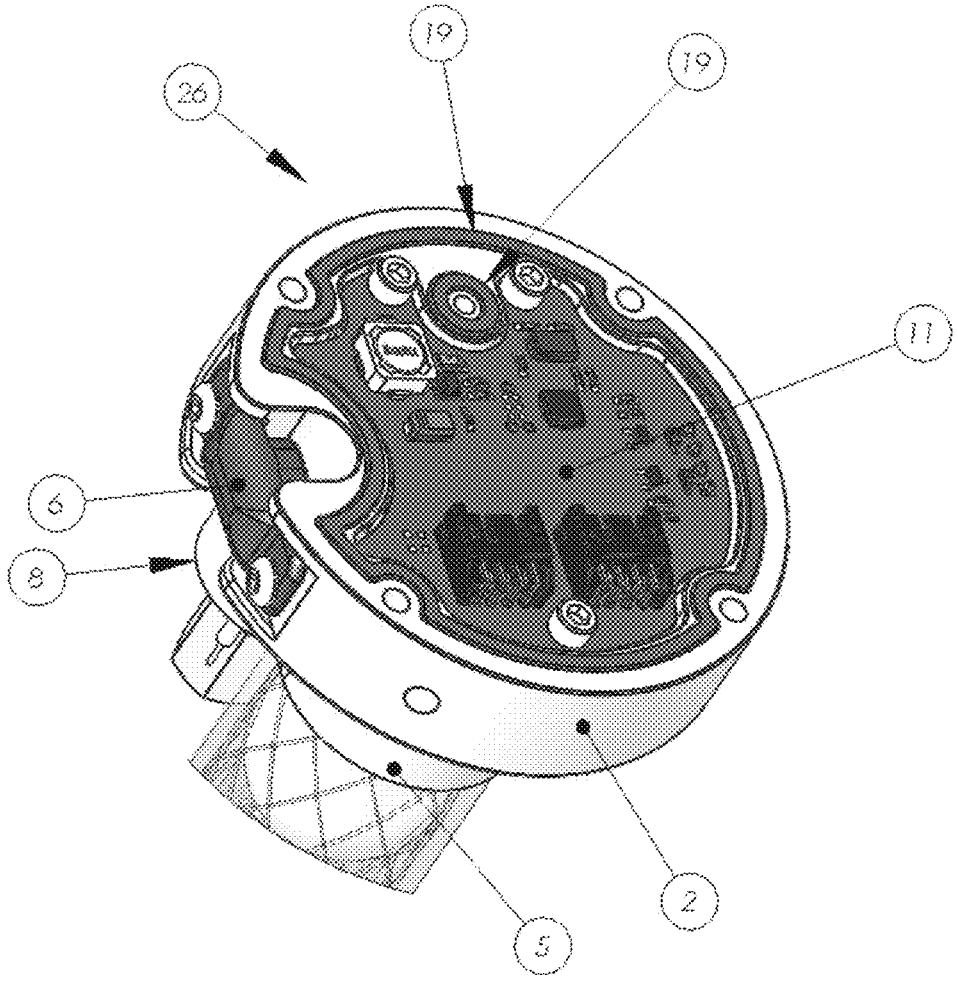
FIG. 11 is an isometric view of the rear base assembly of the flexible actuator assembly of FIG. 1 with a rear cover removed to illustrate internal components of the rear base assembly.

A pneumatic fluid supply inlet 13 is provided on the rear base 2 (see FIGS. 2 and 6). The pneumatic fluid may be air or another gas, for example, nitrogen or carbon dioxide. In some embodiments, a network of pneumatic passageways and valves 8 operate under the control of a control board 11 (see FIG. 11) to selectively apply air to the interior of the tubing 12 on different sides of the ball piston 34 to drive the piston assembly 7 into and out of the pneumatic actuator assembly 26 through the aperture in the front base 1. As illustrated in FIGS. 2 and 6 electrical connection to the control board 11, or directly to valves or other actuators or sensors, for example, pressure or rod position sensors, of the flexible pneumatic actuator assembly 26, may be made to a control system (not shown) remote from the pneumatic actuator assembly 26 via an electrical connector 9, for example, a male electrical connector, coupled to the rear base 2. A cable 10 with an electrical connector, for example, a female connector, complimentary to the electrical connector 9, may mate with the electrical connector 9 and electrically couple the control board 11 (or directly electrically couple valves or other actuators or sensors of the flexible pneumatic actuator assembly 26) to the control system remote from the pneumatic actuator assembly 26. The air may be applied at a high pressure of at least, for example, 100 psi (0.7 MPa). In some embodiments, a liquid, for example, hydraulic fluid, water, or oil may be utilized instead of, or in addition to air, to drive the piston assembly 7 into and out of the pneumatic actuator assembly 26.

The actuator front base 1 is connected to a front end of the tubing 12. The actuator front base 1 includes a fluid (e.g., air) manifold including a pneumatic valve assembly 8 which is configured to manipulate air passageways in the front base 1, diverting air to and through the flexible pneumatic actuator assembly 26. The actuator front base 1 includes a snout 16 with a taper, for example, of about 2°, and an undercut 20 (see FIG. 5). The front end of the tubing 12 is held in place between an external surface of the snout 16 and a tube clamp 5.

The tube clamp 5 seals and holds the tubing 12 in place on the front base 1. The tube clamp 5 has a conical bore with a taper, for example, of about 2°. The conical bore of the tube clamp 5 mates with the snout 16 of the actuator front base 1. The tube clamp 5 is mounted about the front end of the tubing 12 which is in turn mounted about the snout 16 of the front base 1. Pressure applied by the tube clamp 5 to the outside of the tubing 12 induces an internal portion of the tubing 12 to cold flow into the undercut 20 in the snout 16 of the front base 1. The flow of the tubing 12 into the undercut 20 creates a mechanical anchor which prevents the tubing 12 from moving or disengaging from the front base 1 under pressure and bending.

Figure 5:
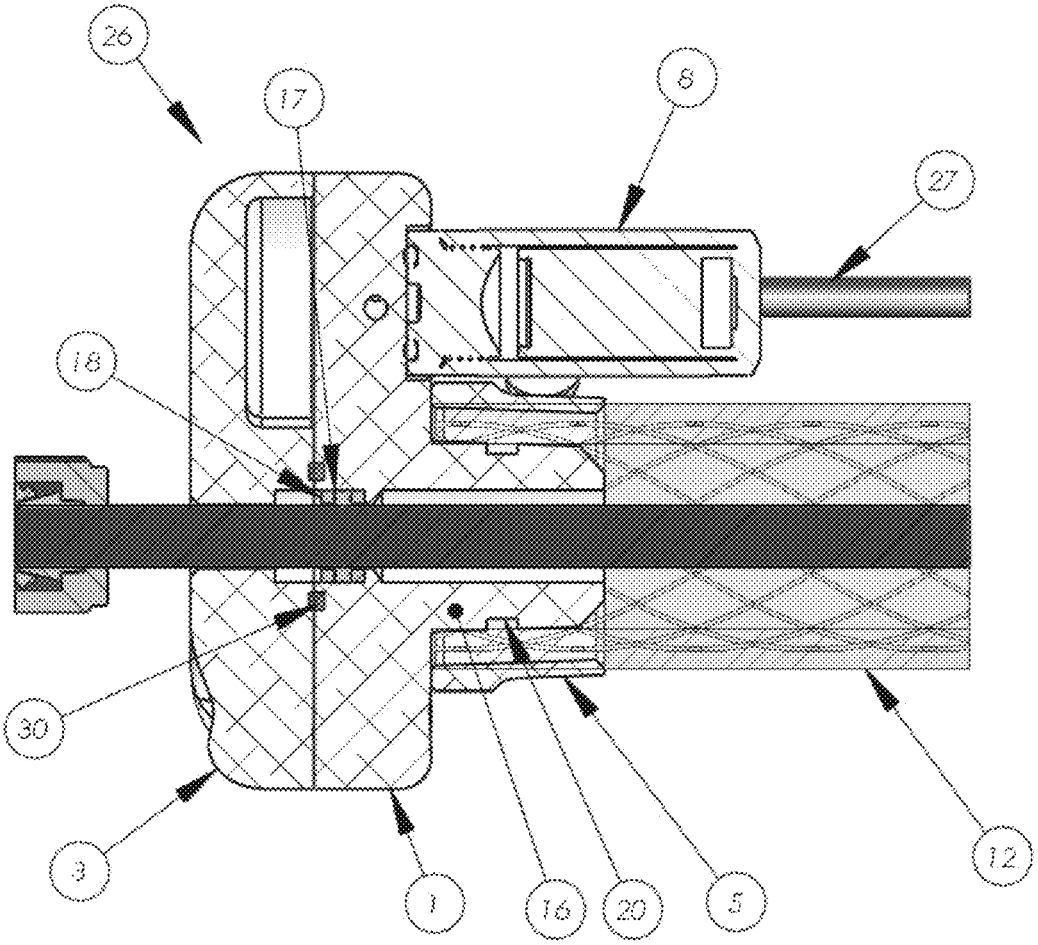
FIG. 5 is a cross sectional view of the front base assembly of the flexible actuator assembly of FIG. 1.

With continued reference to FIG. 5, the actuator front base 1 includes an aperture defining a bore though which a front end of piston rod 32 of the piston assembly 7 passes. The front base 1 includes O-rings 17 and a backup ring 18 through which the aperture passes to provide a pneumatic seal between the front base 1 and the piston rod 32 of the piston assembly 7. The O-rings 17 and/or backup ring 18 maintain an airtight seal on the piston rod 32 even when lateral force is applied to bend the portion of the piston rod 32 protruding from the front base 1. Although O-rings 17 are illustrated in FIG. 5, it should be appreciated that in other embodiments, other forms or geometries of seals, for example, quad seals, X seals, and square seals or packing may be utilized in addition to or as an alternative to the O-rings 17 and/or backup ring 18 to maintain an airtight seal on the piston rod 32 in the aperture in the front base 1.

A nose seal cap 3 is provided on the front face of the front base 1. The nose seal cap 3 gives the front of the flexible pneumatic actuator assembly 26 a streamlined shape, allowing it to easily maneuver around or in objects without catching itself on corners or sharp edges when used in motion. It also provides the remainder of the bore through which the rod 32 of the floating piston assembly 7 passes, providing additional pneumatic sealing between the inside of the tubing 12 and the external environment. The nose seal cap 3 also includes a nose seal O-ring 30, or an alternative type or geometry of seal, which keeps fluid and gases from breaching the flexible pneumatic actuator assembly 26 and its seals.

With reference to FIG. 6, a rear end of the tubing 12 is secured to the rear base 2 using a second tube clamp 5 in a similar manner that the front end of the tubing 12 is secured to the front base 1. In the embodiment illustrated, unlike the front base 1, the rear base 2 does not include any aperture through which the piston rod 32 of the piston assembly 7 may pass. In other embodiments, however, the rear base 2 may include an aperture through which the piston rod 32 of the piston assembly 7 may pass. In some embodiments the rear base 2 also houses an actuator control board 11. The control board 11 provides signals, for example, electrical and/or pneumatic signals to the various valves of the flexible pneumatic actuator assembly 26 to control the flow of air into the front or rear ends of the tubing 12 to drive the piston assembly into or out of the tubing 12 through the aperture in the front base 1. An actuator rear cover 4 shields the electronics of the actuator control board 11 from the elements, provides an inlet 13 for air or other fluid, and also includes one or more features to which linkages can be attached. The rear base 2 also includes a cable clamp 6 (see FIGS. 10 and 11) which acts as a strain relief for electrical cables and/or pneumatic tubes connected to the control board 11. Rear actuator cap gaskets 19 may be provided between a main body of the rear base 2 and a rear cover 4 of the rear base. The rear actuator cap gaskets 19 may act as a boundary between the outside environment and as a seal for air traveling through the rear base 2.

The piston assembly 7 includes a ball piston 34 disposed within the tubing 12 upon which air (and/or another fluid) acts to drive the piston assembly 7 into and out of a body of the flexible pneumatic actuator assembly 26 defined by the tubing 12 between the front base 1 and the rear base 2. The piston 34 is a substantially spherical ball, or a portion of a substantially spherical ball, which is pressed into the inner wall of the tubing 12, creating an interference fit. The interference fit creates an air tight (or fluid tight) seal while still allowing the piston to move back and for the within the tubing 12. The spherical shape of the piston 34 allows the piston 34 to rotate inside of the tubing 12, much like a ball joint socket, during and after bending of the tubing 12. This allows for a constant pneumatic seal under pressure between the piston 34 and the interior wall of the tubing 12.

Flow of air through air passages in the front base 1, the rear base 2, and the tubing 12 is controlled by pneumatic valves 8, which in some embodiments include ASCO® miniature three way universal valves, available from ASCO Valve, Inc. Check valves 14 are assembled onto the exhaust port of the ASCO® valves 8 to prevent contamination from entering the pneumatic system of the flexible pneumatic actuator assembly 26. Some of the benefits of the ASCO® miniature three way universal valve are its compactness and ability to be easily mounted onto the flexible pneumatic actuator assembly 26 rather than having a manifold bank and multiple air lines going to the assembly 26. Only one air supply line and air supply inlet (or pneumatic fluid supply line and pneumatic fluid inlet) is required for the pneumatic actuator assembly 26. Air from the air supply line air is distributed within the front base 1 and rear base, 2, using an internal network of air passageways. The flexible pneumatic actuator control board 11 disposed in the rear base 2 is responsible for activating and deactivating the ASCO® valves 8, manipulating which passageway the air will take, which in turn drives the piston assembly 7 backwards or forwards.

In some embodiments, the tubing 12 includes high pressure Tygothane® polyurethane tubing, available from Saint-Gobain Performance Plastics. The tubing 12 is able to withstand high pressure and maintain a constant inner diameter under pressure. The tubing 12 acts as both a flexible actuator wall for the floating piston assembly 7 and is also the main structural component of the flexible pneumatic actuator assembly 26.

Figure 10:
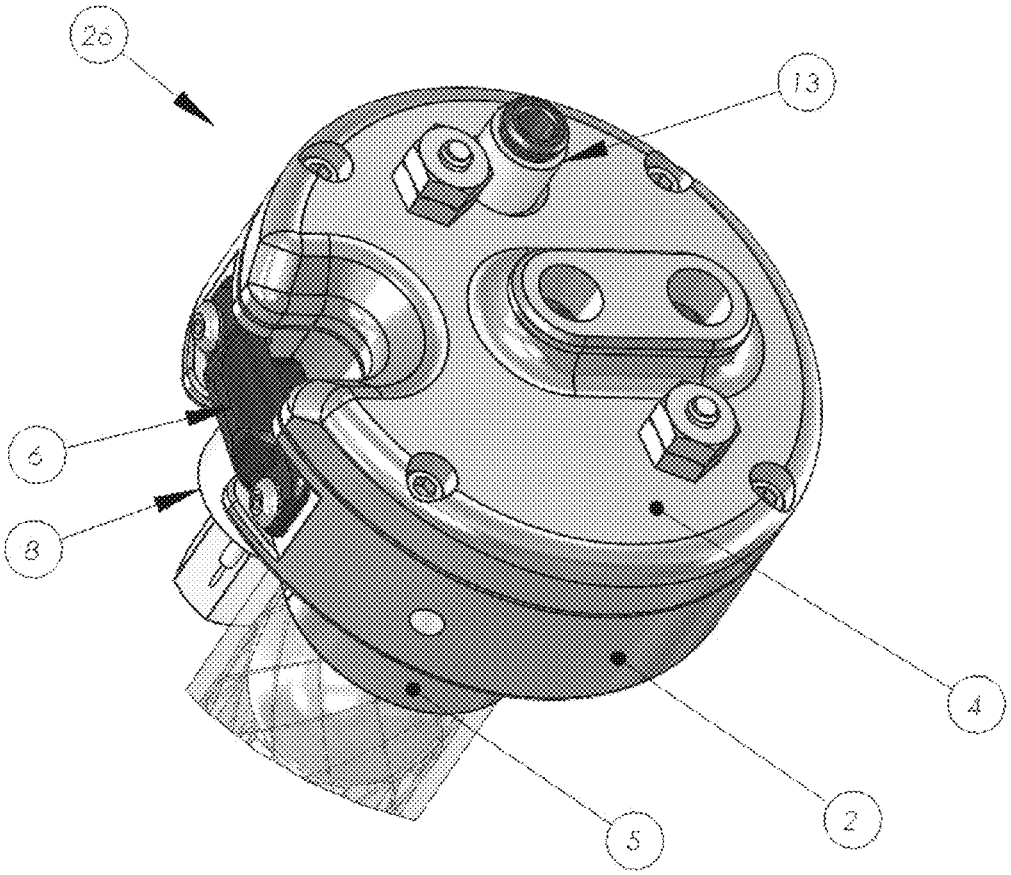
FIG. 10 is an isometric view of the rear base assembly of the flexible actuator assembly of FIG. 1, illustrating the rear side of the rear base assembly.

Referring to FIGS. 2 and 10, a push-to-connect air fitting 13 (or pneumatic fluid fitting) disposed on the rear face of the rear base 2 serves as the air input (or pneumatic fluid inlet) for the flexible pneumatic actuator assembly 26. In operation an air supply, for example, a high pressure air supply is attached to the push-to-connect air fitting 13. A second push-to-connect air fitting 13 is disposed on the front face of the rear base 2 and connects to a rear end of an air tube 27, for example, a 5/32" polyurethane air tube. A front end of the air tube 27 connects to a fitting on the front face of the front base 1, for example, right angle tee air fitting 21. The air tube 27 provides for the passage of air between the front base 1 and the rear base 2. The right angle tee air fitting 21 may be utilized for making air connections to other components. In some embodiments, a liquid, for example, hydraulic fluid or water may be utilized instead of, or in addition to air, to drive the piston assembly 7 into and out of the pneumatic actuator assembly 26. Air tube 27 may this be referred to generally as a pneumatic fluid tube, the air supply may be referred to generally as a pneumatic fluid supply, and air fittings 13 may be referred to generally as pneumatic fluid fittings.

In some embodiments, sealing plugs 15 are installed into drilled holes on the sides of the cylinder front base 1 and the rear base 2. The sealing plugs 15 create a seal for the custom manifolds allowing them to transfer air within the assembly.

The piston assembly 7 further includes a piston rod 32. The piston rod 32 is the portion of the flexible pneumatic actuator 26 that drives its components forward and backward. The piston rod 32 may be constructed from a material, for example, Delrin® acetal resin, fiber reinforced epoxy or another composite, an engineering plastic, or other material that is flexible enough to not plastically deform under bending yet rigid enough to transfer linear forces without buckling. The piston rod 32, in conjunction with the O-ring 17, or other form of seal, in the front base 1, seals the chamber in the tubing 12 in which the piston resides. The flexible piston rod 32 is sufficiently flexible such that portions of the piston rod 32 extending from the front base 1 may bend to provide for application of force to a load in a wide range of directions ranging from co-axially to the body of the pneumatic actuator assembly 26 to up to about 90° or greater relative to the centerline of the body of the pneumatic actuator assembly 26.

The piston rod 32 is connected to the ball piston 34 using a compression tube fitting adaptor 35. When the compression tube fitting adaptor 35 is fastened down onto the piston rod 32 it clamps down onto the piston rod 32 causing the material of the piston rod 32 to cold flow, anchoring the compression tube fitting adaptor 35 to the piston rod. The compression tube fitting adaptor 35 is then fastened to the ball piston 34 by means of a tapped hole in the ball piston 34.

In some embodiments, the ball piston 34 is machined to a specific diameter from a rigid material, for example, 6061-T6 Aluminum bar stock or another suitable metal or other rigid material. The ball piston 34 is then tapped at its base for fastening the compression tube fitting adaptor 35 to the ball piston 34. In other embodiments, the ball piston 34 is formed from an engineering plastic or other material with a low coefficient of friction. In further embodiments, the ball piston 34 includes a core, for example, a metallic core, coated with a material having a low coefficient of friction, for example, polytetrafluoroethylene (PTFE), a PTFE impregnated anodization, and/or other low friction material. Maintaining a low coefficient of friction between the ball piston 34 and the tubing 12 may be advantageous as it allows greater interference between the two parts for greater sealing while minimizing force loss due to sliding friction. The low friction material coating thus facilitates maintaining an air or fluid-tight seal between the ball piston 34 and the inner wall of the tubing 12 and facilitates travel of the ball piston 34 and piston assembly 7 through the tubing. Additionally or alternatively, portions of the ball piston 34 that contact the inner wall of the tubing 12 may be highly polished to provide low friction between the ball piston 34 and the inner wall of the tubing 12.

A rod connecter 33 is fastened to the front end of the piston rod 32. The rod connecter 33 acts as a linkage between the piston assembly 7 and its application. Some possible applications of the flexible pneumatic actuator include use in prosthetics, mobility aids, biomedical implants, robots in confined spaces, control surfaces in aircraft/watercraft, or other systems desirably provided with multiple simultaneous degree of freedom. The rod connecter 33 may be formed with a streamlined shape, allowing it to easily maneuver around or in objects without catching itself on sharp edges when used in motion. The rod connecter 33 also includes a compression tube fitting 31 for connecting to the piston rod 36 inside of the rod connecter 33, thus creating a more compact profile.

When the compression tube fitting 31 is fastened down onto the piston rod 32 it clamps down onto the piston rod 32 causing the material of the piston rod 32 to cold flow, anchoring the compression tube fitting 31 on the front end, or nose, of the piston rod 32.

Having thus described several aspects of at least one embodiment, it is to be appreciated various alterations, modifications, and improvements will readily occur to those skilled in the art. For example, the flexible pneumatic actuator assembly 26 has been described herein as being actuated with air, however, in other embodiments other gasses or liquids, for example, water or oil may be used to actuate the flexible pneumatic actuator assembly 26. Such alterations, modifications, and improvements are intended to be part of this disclosure, and are intended to be within the spirit and scope of the disclosure. One or more features of any one embodiment disclosed herein may be combined with or substituted for one or more features of any other embodiment disclosed. Accordingly, the foregoing description and drawings are by way of example only.

The phraseology and terminology used herein is for the purpose of description and should not be regarded as limiting. As used herein, the term "plurality" refers to two or more items or components. As used herein, dimensions which are described as being "substantially similar" should be considered to be within about 25% of one another. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A flexible pneumatic actuator assembly comprising:

a front base;

a rear base;

a length of flexible tubing having a front end secured to the front base and a rear end secured to the rear base;

a flexible piston rod extending through an aperture in the front base and into an internal volume of the length of flexible tubing; and a piston secured to the piston rod within the internal volume of the length of flexible tubing, the piston configured to maintain an air tight seal against an inner wall of the tubing upon bending of the tubing in a region including the piston.

2. The flexible pneumatic actuator assembly of claim 1, wherein the piston is secured to a rear end of the piston rod within the internal volume of the length of flexible tubing.

3. The flexible pneumatic actuator assembly of claim 1, wherein the piston is substantially spherical in shape.

4. The flexible pneumatic actuator assembly of claim 1, wherein a front end of the piston is secured to the piston rod with a compression tube fitting adapter.

5. The flexible pneumatic actuator assembly of claim 1, wherein the piston is configured to maintain an interference fit against the inner wall of the tubing upon bending of the tubing in a region including the piston.

6. The flexible pneumatic actuator assembly of claim 5, wherein the piston is configured to rotate within the tubing upon bending of the tubing in a region including the piston.

7. The flexible pneumatic actuator assembly of claim 1, further comprising a fluid inlet and a network of pneumatic passageways and valves configured to selectively apply fluid to the interior of the tubing on different sides of the piston.

8. The flexible pneumatic actuator assembly of claim 7, further comprising control circuitry disposed within the rear base and configured to control operation of the valves.

9. The flexible pneumatic actuator assembly of claim 7, wherein the network of pneumatic passageways includes a fluid line pneumatically coupling the front base to the rear base.

10. The flexible pneumatic actuator assembly of claim 1, wherein the front base includes a tapered snout including an undercut and a tube clamp, the front end of the length of tubing secured in place between an external surface of the snout and the tube clamp.

11. The flexible pneumatic actuator assembly of claim 1, further comprising a streamlined nose seal cap disposed on a front face of the front base.

12. The flexible pneumatic actuator assembly of claim 1, further comprising a rear cover sealing a control board in the rear base and including a pneumatic fluid inlet.

13. The flexible pneumatic actuator assembly of claim 1, including a single pneumatic fluid supply line.

14. The flexible pneumatic actuator assembly of claim 1, wherein the piston rod is formed from an engineering plastic.

15. The flexible pneumatic actuator assembly of claim 1, further comprising one or more seals in the aperture forming an air tight seal against the piston rod.

16. The flexible pneumatic actuator assembly of claim 15, wherein the one or more seals maintain an airtight seal on the piston rod when a lateral force is applied to bend a portion of the piston rod protruding from the front base.

17. The flexible pneumatic actuator assembly of claim 1, further comprising a rod connector fastened to a front end of the piston rod.

18. The flexible pneumatic actuator assembly of claim 17, wherein the rod connector is formed with a streamlined shape without sharp edges.

19. The flexible pneumatic actuator assembly of claim 17, wherein the rod connector includes a compression tube fitting disposed within a body of the rod connector, the compression tube fitting securing the front end of the piston rod to the rod connector.

20. The flexible pneumatic actuator assembly of claim 1, wherein the piston includes a flat rear end.

21. The flexible pneumatic actuator assembly of claim 1, wherein the piston rod is configured to apply force to a load in a direction up to about 90° relative to a centerline of the pneumatic actuator assembly.

22. The flexible pneumatic actuator assembly of claim 1, wherein the piston rod is operable to both push and pull on a load after the length of flexible tubing has been bent into a curved state.

23. The flexible pneumatic actuator assembly of claim 1, wherein the piston coated with a friction reducing material.

24. The flexible pneumatic actuator assembly of claim 1, wherein the piston is formed from a low friction material.

* * * * *